United States Patent [19]

Locher

[11] 4,273,243

[45] Jun. 16, 1981

[54] LIFT CENTERING DEVICE

[76] Inventor: Frank S. Locher, R.D. #1 Kepple Hill, Vandergrift, Pa. 15690

[21] Appl. No.: 31,163

[22] Filed: Apr. 18, 1979

[51] Int. Cl.[3] ..... B66C 19/00

[52] U.S. Cl. ..... 212/153

[58] Field of Search ..... 212/11, 21, 18, 40, 212/41, 42.5, 83, 97, 149, 153, 157; 294/86.25, 78 A; 340/685, 686, 665 T, 52 R

[56] References Cited

U.S. PATENT DOCUMENTS

| | | | |
|---|---|---|---|
| 3,228,019 | 1/1966 | Visceglia | 340/685 |
| 3,734,539 | 5/1973 | Salmi | 340/686 |
| 3,826,380 | 7/1974 | Lenander | 212/11 |
| 3,848,750 | 11/1974 | Hoge | 340/685 |

*Primary Examiner*—James B. Marbert
*Attorney, Agent, or Firm*—Harold A. Williamson

[57] ABSTRACT

This invention relates to a load centering device for use in combination with a crane system. The crane system has a cable winding unit with a cable having at least one end secured thereto. The cable supportably passes through a traveling block that includes a hook to be secured to a load to be lifted. The crane system includes a load centering device that has a null condition when the crane system is not in use and the load centering device is in a predetermined spatial relationship with a vertical line and a line which is coincident with the cable center line in the region between the traveling block and the cable winding unit. The load centering device includes a plurality of electrical switch means spatially positioned in respect of the cable such that relative movement of the cable from said predetermined cable center line, vertical line spatial relationship actuates at least one of said electrical switches to provide an indication that the null condition has been disturbed and that said load lifted while said indication is present will not receive optimal lifting from said traveling block of said overhead crane system.

11 Claims, 8 Drawing Figures

LIFT CENTERING DEVICE

Figure 1:
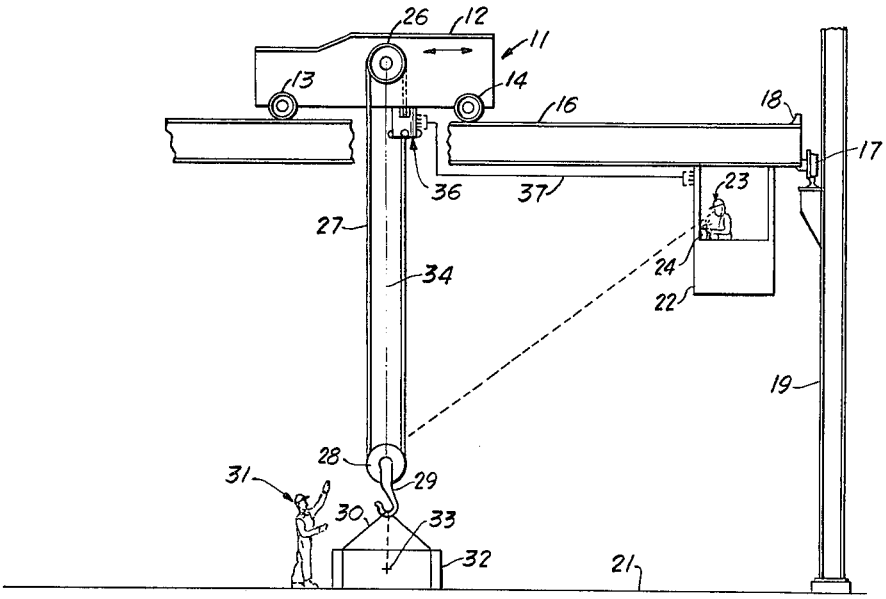

This invention relates to a load centering device for use with cranes.

More specifically this invention relates to a load centering means for use in combination with an overhead crane system having a trolley movably mounted on a bridge girder. In the simplest form possible, the trolley has a cable winding drum with a cable having an end secured to the drum. The cable supportably passes through a traveling block and has its other end secured in respect to the trolley and this traveling block. In another arrangement the cable has both of its ends secured to the drum and the cable there between supportably carries the traveling block. This arrangement also includes an equalizer cable which is secured respectively to the drum, traveling block and trolley. In the simplest form possible the traveling block includes a hook to be secured to a load to be lifted. The load centering device surrounds the cable in the simplest form or the equalizer cable in the other arrangement and is positioned between the trolley and the traveling block. The load centering device has a null condition when the crane is not in use and the load centering device is in a predetermined spatial relationship with a vertical line and a line which is coincident with the cable center line in the region between the traveling block and the secured end of the cable. The load centering device includes a plurality of electrical switch means spatially positioned in respect of the cable such that relative movement of the cable from said predetermined cable center line, vertical line spatial relationship actuates at least one of said electrical switches to provide an indication that the null condition has been disturbed and that said load lifted while said indication is present will not receive optimal lifting from said traveling block of said overhead crane system.

In the world today there are literally thousands of overhead crane systems in operation. These overhead cranes are found in a variety of industrial, manufacturing and fabrication environments. Those faimiliar with overhead crane systems are aware that one crane system with a single operator is a cab secured to a movable trolley and bridge girder may be responsible for the safe transfer within a facility of thousands of tons of finishing products which products are often irregular in shape. In addition, the products may have a center of gravity in a location that is not apparent from a viewing of the product on the floor. A worker on the floor adjacent a large casting, for example, has the job of securing the hook of a traveling block to the casting. The traveling block is brought to the scene by an operator in a cab traveling with a movable bridge on which there is a trolley with a winding drum and cable secured to the drum and the traveling block.

The operator in the cab in many instances is high above the ground and therefore at some distance from the point at which the hook of the traveling block is being connected to the load i.e. casting. An exchange of hand signals between worker and operator in the cab results in the location of the trolley and its cable supported traveling block directly above the load. The worker on the floor adjusts a sling around portions of the load in a fashion he estimates will when secured to the hook of the traveling block result in a lifting force transmitted to the load's center of gravity. The worker on the floor steps back after he has initially made the connection of the hook, and the crane operator applies a slight lift control to remove slack from the cable and provide tension in the cable between the winding drum on the trolley and the traveling block. As the crane operator provides more lift control and the load begins to have its weight countered by the lifting force exerted by the crane system there comes a "moment of truth" in respect of whether the resultant lift force will be applied via the traveling block hook to and through the load's center of gravity. It is at this point in time when the keenness of the operator's eye is called upon to observe whether the cable to the traveling block is disposed while in initial tension at angle away from the vertical. Depending upon the angle of the cable's displacement from the vertical, the operator may or may not be able to see it. If there is an attempt to lift the load and the lifting force is off center, as soon as the load is free of the floor there will arise a moment force released as the load attempts to align its center of gravity with the vertical lifting force of the overhead crane system. When the load swings a very dangerous situation arises. The swinging load may strike the worker on the floor or the crane operator may drop the load to stop the unexpected swing and thereby damage the load. If the swing is sufficiently large the hook connection of the traveling block and the chains or cables that secure the load to the hook may become unsecured and the load will fall to the floor with possible damage to itself and the workers on the floor in the vicinity.

It is to the problem defined above that the invention to be described hereinafter is addressed.

It is a primary object of the invention to provide an apparatus that readily provides an indication as to whether a load to be transported by an overhead crane is properly centered in respect of the overhead crane system's lifting mechanism.

Another object of this invention is to provide for enhanced safety in lifting loads with overhead cranes by the utilization of a compact load centering sensing device which may be located at the trolley of an overhead crane system, traveling block or on a traveling block which is adjacent the load to be lifted by overhead crane system.

In the attainment of the foregoing object the invention calls for a load centering device used in combination with an overhead crane system which has a trolley mounted on a bridge girder. The trolley has mounted thereon a power driver cable winding drum with a cable having at least one end secured to the drum. The cable supportably passes through a traveling block and is secured in respect to the trolley and traveling block. The traveling block includes a hook to be secured to the load to be lifted.

The load centering device surrounds the cable and is positioned between the trolley and the traveling block. In one embodiment of the invention the load centering device is secured to the trolley. In a second embodiment the load centering device is positioned in a region near the traveling block and in yet another embodiment the load centering device is secured to the traveling block.

The load centering device in all embodiments has what is termed a "null condition" which occurs when the crane system is not in use and the load centering device is in a predetermined spatial relationship with a vertical line and a line which is coincident with the cable center line in the region between the traveling block and the secured other end of the cable.

The load centering device includes a plurality of electrical switches spatially positioned in respect of the cable such that relative movement of the cable from the predetermined cable center line-vertical line spaced relationship actuates at least one of the electrical switches to provide an indication that the null condition has been disturbed and should the load be lifted while the indication is present the load will no receive apteral lifting from the traveling block of the overhead crane system.

In the invention's second embodiment that provides for the load centering device to be positioned in the region near the traveling block the electrical switch means are of the mercury type which are responsive to gravity and provide the indication that the null condition has been disturbed.

In the invention's third embodiment the load centering device is positioned on the traveling block and functions in a manner similar to the second embodiment.

The load centering device also contemplates the inclusion of lights located at the device itself or remote therefrom to thereby provide a visual indication of disturbed null condition to thereby afford the crane operator the opportunity to make corrections in the overhead crane's position to ensure that the load is properly centered prior to lifting.

Figure 1A:
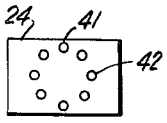
Figure 2:
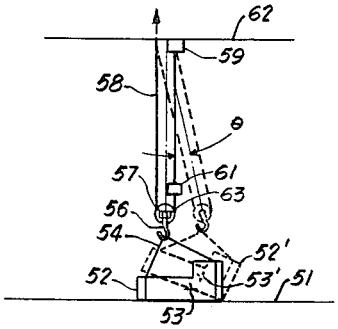
Figure 3:
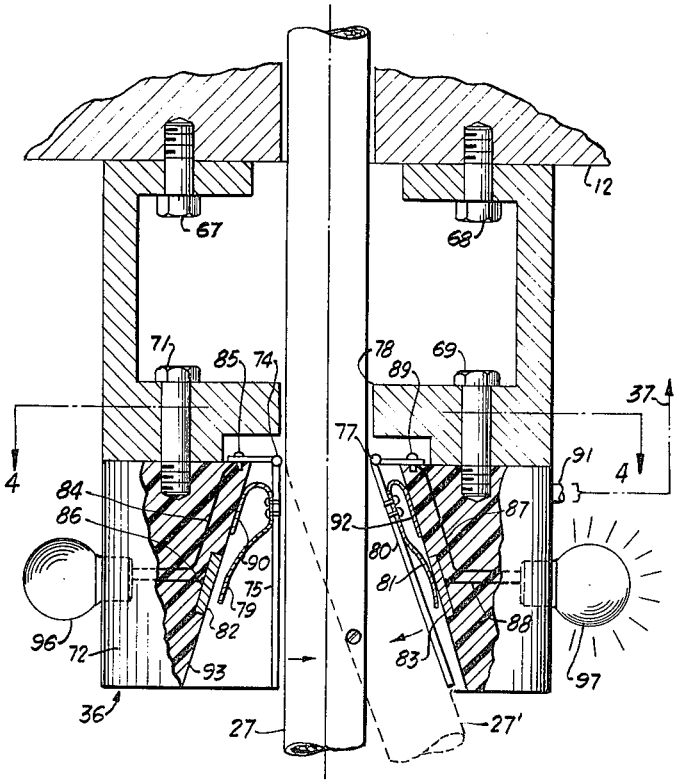
Figure 4:
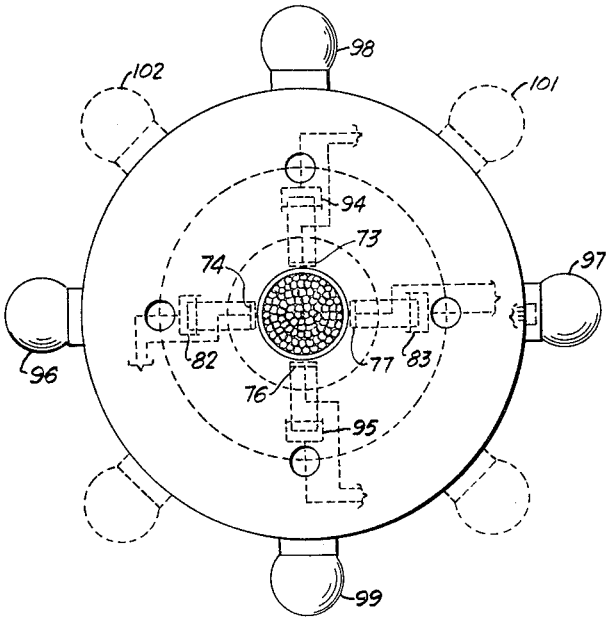
Figure 7:
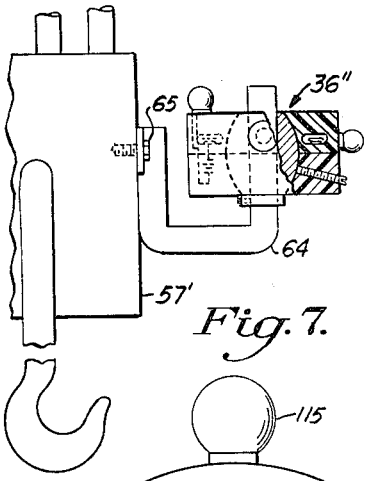
Figure 5:
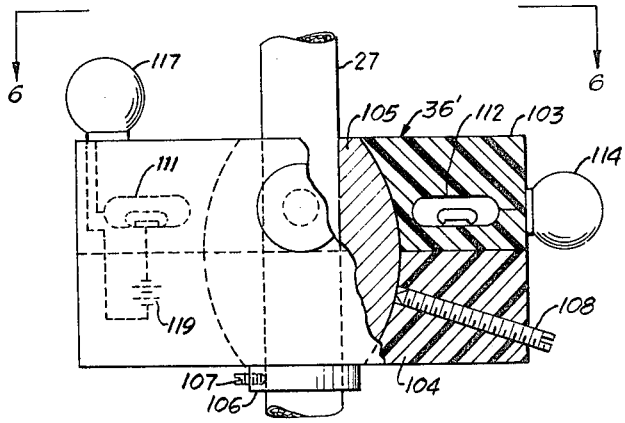
Figure 6:
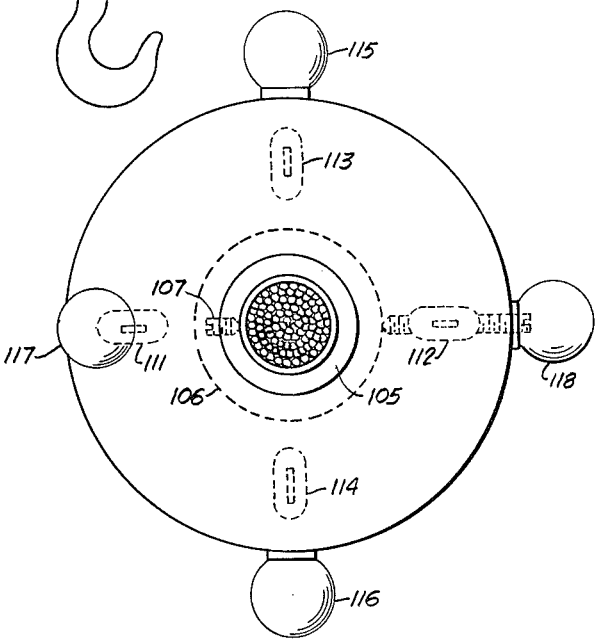

Other objects and advantages of the present invention will become apparent from the ensuing description of illustrative embodiments thereof, in the course of which reference is had to the accompanying drawings in which:

FIG. 1 shows an overhead crane system in simplified form in which the invention is employed, and FIG. 1*a* depicts an illuminated control panel for use in a crane control cab of FIG. 1, and FIG. 2 is a schematic illustration of the working environment in which the load centering device of the invention finds utility, and FIG. 3 is a partial cross sectional view of the preferred embodiment of the invention, and FIG. 4 is a view taken along line 4—4 in FIG. 3, and FIG. 5 is a partial section side view of a second embodiment of the invention, and FIG. 6 is a top view of FIG. 5, and FIG. 7 is a third embodiment of the invention.

A description of the above embodiments will follow and then the novel features of the invention will be presented in the appended claims.

Reference is now made to FIG. 1 in which there is depicted a schematic representation of the overhead crane environment where the invention to be described more fully hereinafter finds its primary utility. An overhead crane system 11 includes a trolley 12 mounted for movement on wheels 13, 14. The wheels 13, 14 are driven by motors not shown and movement of the trolley is controlled from the crane control cab 22 by crane operator 23. The wheels 13, 14 of the trolley 12 ride upon the upper surface of a bridge girder 16. The bridge girder 16 has, as can be seen at its right-hand end support wheel 17 which in turn rides upon the upper surface of a bridge support column 19. A motor 18 is drivingly connected to the bridge support wheel 17 by a drive mechanism not shown. The other end of the bridge girder 16 though not shown is supported in a similar fashion. The motor 18 is controlled by operator 23 via an electrical connection not shown.

The trolley 12 has mounted thereon a cable winding drum 26 which is driven by a motor not shown. The cable winding drum 26 and its motor are controlled by operator 23 via an electrical connection not shown. The cable winding drum 26 has secured thereto a cable 27 which cable 27 passes downwardly to and through a traveling block or shieve 28 and thence upwardly where in this embodiment the other end of the cable 27 passes through the lift centering device 36. The lift centering device 36 is shown here schematically and will be described in complete detail in the discussion that follows in respect to FIG. 3 and FIG. 4. An electrical connection 37 interconnects the lift centering device 36 with a control panel 24 located in the crane control cab 21.

Reference is now made to FIG. 1*a* which shows the surface appearance of the control panel 24 mounted on the panel 24 are a plurality of lights 41, 42 which may be more or less than the number shown for reasons that will be set forth hereinafter.

Returning now to FIG. 1 it will be noted that the traveling block 28 has secured thereto a hook 29 which acts upon a sling 30 connected to a load 32. For purposes of illustration the load 32 has been shown to be symmetrical in shape and has its center of gravity 33 located at a visually locatable center point. The cable winding drum 26, cable 27 and traveling block 28 have a vertical line 34 along which line 34 the lifting force applied to the hook 29 and load 32 will act. This lifting force along the vertical line 34 passes as is shown here through the center of gravity 33 of the load 32. In the situation depicted here the actuation of the cable winding drum 26 by operator 23 will result in a perfectly balanced load lifting. The balanced load lifting is referred to as a "null condition" in the description that hereinafter follows. On the floor 21 adjacent the load 32 is depicted a floor worker 31 whose task it is to connect the hook 29 and sling 30 to the load. In addition, the floor worker 31 gives hand signals to the crane operator 23 to guide the crane operator 23 in the location of the traveling block in respect of the load 32.

Reference is now made to FIG. 2, which depicts in diagrammatic form the setting both static and dynamic in which the invention finds its utility. Even though different reference numerals are employed in the description that follows from those reference numerals employed for like items in FIG. 1 it is believed that the overall arrangement can be readily visually compared to the arrangement in FIG. 1.

Accordingly, FIG. 2 depicts a load 52 resting on the floor 51 which is not symmetrical in shape and therefore has its center of gravity 53 located at a point that is or may not be at a point readily located by the eye of an experienced worker on the floor. The load is shown connected by a sling 54 to hook 56 of the traveling block 57. A cable 58 with an arrow shown at its upper end to indicate the direction of pull passes through the traveling block 57 and is secured to an overhead crane trolley support structure. The cable 58 passes through lift centering device 59, which contains the invention, prior to being secured to overhead crane trolley support structure 62. The location of the lift centering device 59 is shown where in the preferred embodiment it could be located for optimum performance. In crane systems where the lifting cable has both its ends secured to the drum and the traveling block carried by the cable there between, there is provided an equalizer cable which functions in a fashion not unlike the schematic illustration depicted in FIG. 2. It is significant to note that the invention requires that whatever portion of a cable passes through the lift centering device be nonmoving relative to the lift centering device itself.

Shown directly beneath and surrounding cable 58 is an alternate location for a lift centering device 61. The lift centering device 61 of a second embodiment of the invention and its operation will be described more fully in respect of FIG. 5 and FIG. 6.

Also shown in FIG. 2 is the position of the load centering device 63 of the third embodiment of the invention. The operation of this third embodiment will be explained more fully in respect of FIG. 7

FIG. 2 also shows in broken line fashion the location of the cable 58, traveling block 59 and load 52 after a lifting force has been applied to cable 58. In the broken line depiction, the reference elements are marked with prime designations i.e. 59', 57', 52', 53' etc.

The FIG. 2 illustration is intended to convey in an exagerated fashion the angle of displacement between a vertical line and a line coincident with the cable 58 when the overhead crane system is attempting to lift load 52 with the center of gravity 53 of the load not centered in respect of a vertical line that would pass through the traveling block 57 and its hook when the arrangement is in a "null condition" as explained in respect of FIG. 1.

As a lifting force is applied to the cable 58 the cable 58 and its traveling block are forced away from their null condition and are drawn into alignment with the center of gravity 53 of the load 52. When there is sufficient force to begin lifting the load 53 in an uneven fashion this load will move into the position shown by load 52' with its center of gravity 53' displaced as shown. It can therefore be seen that the entire cable and traveling block arrangement shifts through the angle $\theta$. In the event that a continued lifting force were applied the entire load 52 would be dragged to the lift as this FIG. 2 is viewed. Should the lifting force be sufficient the entire load 52 would leave the floor 51 and there would be a dangerously swinging load that might break free of its sling 54 and fall to floor 51, where it could be damaged as a consequence of the fall. Even worse, a floor worker might be struck and injured by the suddenly shifting load.

The lift centering device to be described now provides for the detection and giving of an indication that a load about to be lifted does not have its center of gravity coincident with the resultant lift force being exited by the overhead crane arrangement. The indication which is given allows the crane operator and floor worker often times acting in conjunction an opportunity to adjust the sling and hook arrangement to thereby optimize lifting and remove the possibility of an attempted lift of a load that has a center of gravity at an unsafe distance from a vertical line that passes through the cable winding drum and ideally through the traveling block and the center of gravity of the load.

Reference is now made to FIG. 3 and FIG. 4 which should be studied in conjunction with each other as the description unfolds. FIG. 3 and FIG. 4 represent the preferred embodiment of the invention.

At the top of FIG. 3 there is shown a portion of the trolley 12 on which is secured the load centering device 36 containing the invention. The load centering device 36 has two major components, namely an annular support flange 66 secured by bolts 67, 68 to the trolley 12 and an annular switch block 72 secured to the annular support flange 66 by bolts 69, 71 in the manner depicted in FIG. 3. The annular support flange 66 is made of metal and this annular switch block is made of high density thermosetting plastic. The material composition of the annular switch block is not critical to the invention as long as the material has sufficient strength and the electrical switches and electrical leads to be described more fully hereinafter can be insulated one from the other.

A cable 27 comparable to that shown in FIG. 1 is shown passing through central opening 78 of the annular flange 66 of the load centering device 36 and secured to the trolley 12 in a manner not shown. The details of the cable 27 connection are not critical to the operation of the invention as shown. It should be understood that the cable 27 while shown here connected to the trolley 12 could also pass back over a freely mounted pulley carried by the trolley 12 and be secured to the traveling block in which case the second embodiment of the invention shown in FIG. 5 and FIG. 6 would be utilized.

The annular switch block 72 includes a plurality hinged switches of which in FIG. 3 hinged switches 74, 77 can be seen in section. The remaining switches 73, 76 can be seen in FIG. 4. Hinged switch 74 has a dependent pivotally mounted switch plate 75 and hinged switch 77 has dependently mounted switch plate 80. Each hinged switch 73, 74, 76, 77 is secured to the annular switch block 72 by screws, such as screws 85, 89 which can be seen in FIG. 3. The screws 85, 89 also serve to secure respectively the electrical leads 84, 87 to the hinged switches 74, 77. Switch plates 75, 80 have as noted earlier spring contacts 79, 81 which are secured to the switch plates 75, 80 by rivet shown but not referenced. Each spring contact such as contacts 79, 81 include null biasing portions 90, 92. These null biasing portions 90, 92 act to maintain the switch plates 75, 80 in a vertical position when the cable 27 is in the position shown with its center line coincident with the central opening 78 of the annular support flange 66. The annular switch block 72 has a cone shaped inner surface 93. The angle of the cone shaped inner surface will depend upon the height above the floor at which the load centering device 36 is located. As a general rule the higher the elevation from the floor the load centering device 36 is located the smaller the angle between the inner cone surface and a vertical line that will pass through and be coincident with switch plates 75, 80 when the "null condition" is present.

For purposes of illustration only the inner cone surface 93 is shown at the angle it is to thereby facilitate the understanding of the invention's operation.

FIG. 3 also shows cable 27 in dashed outline as cable 27'. In this position the cable 27' is experiencing the conditions present as shown and explained in FIG. 2 in respect of load 52'.

The annular switch block 72 contains a plurality of switch contact plates 82, 83, (which can be seen in FIG. 3) and 94, 95 identified in FIG. 4. The switch contact plates have secured thereto, respectively, electrical leads 86, 88. Leads 86, 88 are serially connected to lights 96, 97. A complete circuit for each light would include, for example, in respect of light 97, a source of power (not shown) connected serially to lead 87, hinged switch 77, switch plate 80, spring contact 81, lead 88 and light 97. Only one circuit has been described and it should be understood that a variety of circuits are possible that would allow the illumination of light 97 whenever spring contact 81 made contact with switch plate 83. The circuit just described can be connected via terminal 91 over lead 37 to the cab 22 and its control panel 24 to provide a remote indication of the disturbed null condition caused by the conditions at the load on the floor below.

In the preferred embodiment only four lights 96, 97, 98, 99 are shown. Each light to represent movement away from the "null condition" in each of four quadrants. There are shown in dashed outline additional lights 101 and 102 which represent yet another variation to the invention that would allow a greater number of indications and provide for the refinement of control of the load centering device embodying the invention.

From the details of construction of the lift centering device 36 described above it is apparent that whenever the cable 27 is vertically disposed and the hook placed upon a load to be lifted, that so long as the lifting attempt does not cause the cable to move from the vertical the crane operator need not concern himself with an off-centered load. When one of the indication lights come on, both the operator on the floor and the crane operator know that there will have to be further adjustment before they can proceed to safely lift the load.

Reference is now made to FIG. 5 and FIG. 6 which should be studied together. FIG. 5 and FIG. 6 illustrate the details of a second embodiment of the invention. In this embodiment the lift centering device 36' is located in the region shown in FIG. 2 where reference numeral 61 indicates the location. Though not shown it is important to recognize that the cable 27 would have to have an end secured to the traveling block rather than the trolley in order to preclude relative movement between the cable 27 and the lift centering device 36.

The lift centering device 36' has passing there through cable 27 which has secured thereto by collar 106 and screws 107 a central bearing member 105. The central bearing member 105 has adjustably position thereon an upper portion of the lift centering device 103 and a lower portion 104. The upper and lower portions 103, 104 are secured to each by means not shown such as screws or bolts. In the lower portion 104 an adjustment screw 108 is threadably disposed to provide for the relative adjustment of lift centering device's upper and lower portions 103, 104. This adjustment capability allows for the setting of a null position that takes into account minor initial cable traveling block variations.

Located in the upper portion 103 are a plurality mercury type switches 111, 112, 113, 114 of conventional nature. These mercury switches are disposed so as to provide a switch in each quadrant. A plurality of lights 115, 116, 117, 118 are electrically connected to each of the switches. The light 117 is shown electrically connected across mercury switch 111 and battery 119. While not shown in this embodiment the invention contemplates the addition of multiple signal transmitters of the type that need only have a range of a few hundred feet. Transmitters of this type actuated into transmission by the level sensing mercury switches 111, 112, 113, 114 can provide a remote indication in the crane control cab if such indication is desired.

Reference is now made to FIG. 7 which illustrates the third embodiment of the invention where the lift centering device is secured to a traveling block 57'. The lift centering device 36'' is of the same construction as that depicted and described in FIGS. 5 and 6. The only difference residing in the fact that the lift centering device 36'' is not secured to a cable but rather to an arm 64 secured by bolts one of which 65 is shown. In this embodiment the same dynamics of operation as those described with respect to FIGS. 5 and 6 are present. It will be appreciated that this embodiment of the invention can be used in any crane environment whether it be an overhead system or boom crane.

While the present invention has been illustrated and disclosed in connection with the details of the illustrative embodiments thereof, it should be understood that those illustrative embodiments are only to be limitative of the invention as set forth in the accompanying claims.

I claim:

1. A crane load centering means for use in combination with a crane system, said crane system having a cable winding means with a cable having at least one end secured thereto, said cable supportably passing through a traveling block, said traveling block including hook means to be secured to a load to be lifted, a load centering means secured to said traveling block and positioned adjacent and positioned away from said traveling block and out of contact with said cable, said load centering means having a null condition when said crane system is not in use and said load centering means is in a predetermined spatial relationship with a vertical line and a line which is coincident with the cable center line in the region between said traveling block and said cable winding means, said load centering means including at least four electrical switch means spatially positioned in respect of said cable such that relative movement of said predetermined cable center line, vertical line spatial relationship actuates at least one of said electrical switches to provide an indication that said null condition has been disturbed and that should said load be lifted while said indication is present, said load will not receive optimal lifting from said traveling block of said crane system.

2. A crane load centering means for use in combination with a crane system having a trolley movably mounted on a bridge girder, said trolley having a cable winding drum with at least one cable having one end secured to said drum, said cable supportably passing through a traveling block and having its other end secured in respect of said trolley and said traveling block, and said traveling block including hook means to be secured to a load to be lifted, said load centering means surrounding and passing through a portion of said cable and positioned between said trolley and said traveling block, said portion of said cable passing through said lift centering means being nonmoving through said lift centering means, said load centering means having a null condition when said crane system is not in use and said load centering means is in a predetermined spatial relationship with a vertical line and a line which is coincident with the cable center line in the region between said traveling block and said secured other end of said cable, said load centering means including at least four electrical switch means spatially positioned in respect of said cable such that relative movement of said cable from said predetermined cable center line, vertical line spatial relationship actuates at least one of said electrical switches to provide an indication that said null condition has been disturbed and that should said load be lifted while said indication is present, said load will not receive optimal lifting from said traveling block of said overhead crane system.

3. The load centering means and overhead crane system combination of claim 2 wherein said cable's other end is secured to said trolley.

4. The load centering means and overhead crane system combination of claim 2 wherein said cable's other end is secured to said traveling block.

5. The load centering means and overhead crane system combination of claim 2 wherein said traveling block has integrally secured thereto a hook means for connection with a load to be lifted, said overhead crane system having optimum lift performance when said vertical line passes through the center of gravity of said load and said traveling block, said load centering means providing said indication whenever said hook is secured to a load which center of gravity is not coincident with said vertical line.

6. The load centering means and overhead crane system combination of claim 3 wherein said crane centering means is mechanically secured to said trolley.

7. The load centering means and overhead crane system combination of claim 4 wherein said crane centering means is mechaically secured to said traveling block.

8. The load centering means and overhead crane system combination of claim 6 wherein said electrical switches are spatially position such that there is at least one switch in each quadrant within a plane passing through said lift centering means and at right angles to said cable when said null position is present.

9. The load centering means and overhead crane system of claim 3 wherein said indication is provided by a light source electrically coupled to said electric switch means.

10. The load centering means and overhead crane system of claim 4 wherein said indicator is provided by a light source electrically coupled to said electric switch means.

11. The load centering means and overhead crane system of claim 7 wherein said electrical switch means are mercury switch means which mercury is responsive to gravitational forces.

* * * * *